US005232398A

United States Patent [19]

Maki

[11] Patent Number: 5,232,398

[45] Date of Patent: Aug. 3, 1993

[54] DISC CONVEYOR

[75] Inventor: Tadanori Maki, Ibaraki, Japan

[73] Assignee: Himecs Co., Ltd., Osaka, Japan

[21] Appl. No.: 658,061

[22] Filed: Feb. 20, 1991

[51] Int. Cl.[5] ..... G07D 1/00

[52] U.S. Cl. ..... 453/57; 198/397; 453/56

[58] Field of Search ..... 453/30, 32, 56, 57; 221/267; 198/392, 393, 397

[56] References Cited

U.S. PATENT DOCUMENTS

| | | | |
|---|---|---|---|
| 3,698,537 | 10/1972 | Black et al. | 198/397 X |
| 3,910,295 | 10/1975 | Fletcher | 453/56 X |
| 4,261,377 | 4/1981 | Ueda | 453/32 X |
| 4,342,384 | 8/1982 | Fukase et al. | 453/56 X |
| 4,457,321 | 7/1984 | Watanabe et al. | 453/32 |
| 4,474,197 | 10/1984 | Kinoshita et al. | 453/57 |
| 4,902,263 | 2/1990 | Ito et al. | 453/57 X |
| 4,943,258 | 7/1990 | Abe | 453/30 |
| 5,046,989 | 9/1991 | Dass | 453/32 X |

FOREIGN PATENT DOCUMENTS

| | | | |
|---|---|---|---|
| 2231720 | 1/1973 | Fed. Rep. of Germany | 453/57 |
| 3830674 | 3/1990 | Fed. Rep. of Germany . | |
| 133810 | 9/1985 | Japan . | |
| 1232457 | 5/1986 | U.S.S.R. | 198/397 |
| 1490054 | 6/1989 | U.S.S.R. | 198/393 |
| 1386304 | 3/1975 | United Kingdom | 453/56 |
| 2185341 | 7/1987 | United Kingdom | 453/57 |

*Primary Examiner*—Michael S. Huppert
*Assistant Examiner*—William M. Hienz
*Attorney, Agent, or Firm*—Webb, Burden, Ziesenheim & Webb

[57] ABSTRACT

A disc conveyor for conveyor for conveying disc-like objects is disclosed. The conveyor includes a feeding device for serially feeding a plurality of disc-like objects, a forcible transporting device for forcibly transporting the objects fed from the feeding device, a drive source for selectably driving either the feeding device or the forcible transporting device and a correlating mechanism for operatively correlating the feeding device and the forcible transporting device.

12 Claims, 4 Drawing Sheets

DISC CONVEYOR

BACKGROUND OF THE INVENTION

1. Field of the Invention

The present invention relates to a disc conveyor, and more particularly to a conveyor including a feeder device for serially feeding a plurality of disc-like objects and a forcible transporting device for forcibly transporting the objects to a predetermined position after receiving the objects from the feeder device.

2. Description of the Related Art

A typical disc conveyor of the above-noted type is disclosed by a Japanese laid-open utility model gazette No. 60-133810.

This conventional conveyor includes a first electric motor for driving the feeder device for feeding coins as an example of the disc-like objects and a second electric motor for driving the forcible transporting device for receiving the coins from the feeder device and then transporting the coins to an upper position, such that the coins are transported to a desired position through operations of the two electric motors.

With the above-described convention, however, if, for example, the second electric motor for the forcible transporting device breaks down while the first electric motor is energized for serially feeding the coins, the coins successively fed by the feeder device will accumulate in the conveyor, whereby jamming problem occurs. And, elimination of these jammed coins takes a great amount of time and labor.

Further, for varying a feeding amount, per unit time period, of the coins with the above convention, a velocity of the first electric motor must be changed. With this, a velocity of the second electric motor must be changed as well in accordance with the variation in the velocity of the first electric motor. Therefore, the adjustment of the feeding amount tends to be troublesome.

Then, the primary object of the present invention is to provide a disc conveyor of the above type with an improvement which reliably prevents occurence of the inconvenience due to troubles of driving sources and which faciliates adjustment, i.e. variation of the feeding amount of the disc-like objects.

SUMMARY OF THE INVENTION

For accomplishing the above-described object, a disc conveyor, according to the present invention, comprises: a feeding device for serially feeding a plurality of disc-like objects; a forcible transporting device for forcibly transporting the objects fed from the feeding device; a drive source for selectably driving either said feeding device or said forcible transporting device; and a correlating mechanism for operatively correlating said feeding device and said forcible transporting device.

Functions and effects of the above-described construction will now be described.

With energization of the single drive soure, one of the feeding device and the forcible transporting device is actuated, with which the other is also driven through the correlating mechanism so that the objects serially fed from the feeding device are forcibly transported in a predetermined order to a desired position.

When the drive source breaks down, both the feeding device and the forcible transporting device remain unactivated. Accordingly, there occurs no jamming which occurs when the feeding device continues to feed objects after the transporting device has stopped.

Further, with the conveyor of the present invention, variation of the per-unit-period feeding amount of the feeding device can be readilly effected by varying the velocity of the single drive source, which velocity variation automatically changes the feeding speed of the feeding device as well as the transporting speed of the transporting device.

As described above, the invention has fully achieved the intended primary object of providing a disc conveyor of the above type with an improvement which reliably prevents occurence of the inconvenience due to troubles of driving sources and which faciliates adjustment, i.e. variation of the feeding amount of the disc-like objects. More particularly, even when the single drive source breaks down, entire conveyor stops whereby no jamming trouble occurs due to accumulation of the objects continuously fed from the feeding device. And, restoration of the system can be completed merely by repairing or replacing the single drive source.

Also, adjustment of the feeding speed or rate of the disc-like objects can be readily done by appropriately varying the velocity of the single drive source, unlike the convention where the adjustment must be done for the two electric motors while maintaining the predetermined operative relationship relative to each other.

According to one preferred embodiment of the present invention, the feeding device serially feeds the objects one by one and the forcible transporting device receives and holds the objects fed in a serially aligned state from the feeding device; counter means being provided for detecting and counting the number of the objects; the correlating mechanism being so constructed as to render a transporting speed of the forcible transporting device higher than a feeding speed of the feeding device.

With the above construction, the feeding device feeds the disc-like objects one after another with a predetermined distance therebetween. Thereafter, the forcible transporting device transports these fed objects by a transporting speed which is higher than the feeding speed of the feeding device, such that the objects are transported with a distance greater than the feeding distance of the feeding device. As a result, the objects may be counted with high precision even if the detection precision of the counter means is relatively moderate.

As another advantage of the increased transporting distance relative to the feeding distance described above, a sensor used for sensing the disc-like objects in counting its number may be of a relatively low precision. As a result, the invention has achieved greater accuracy in the counting of the objects as well as reduction in the entire system costs.

Further and other objects, features and effects of the invention will become more apparent from the following more detailed description of the embodiments of the invention with reference to the accompanying drawings.

BRIEF DESCRIPTION OF THE DRAWINGS

Accompanying drawings illustrate a disc conveyor according to preferred embodiments of the present invention; in which.

DESCRIPTION OF THE PREFERRED EMBODIMENTS

Preferred embodiments of a disc conveyor relating to the present invention will now be described in particular with reference to the accompanying drawings.

Figure 1:
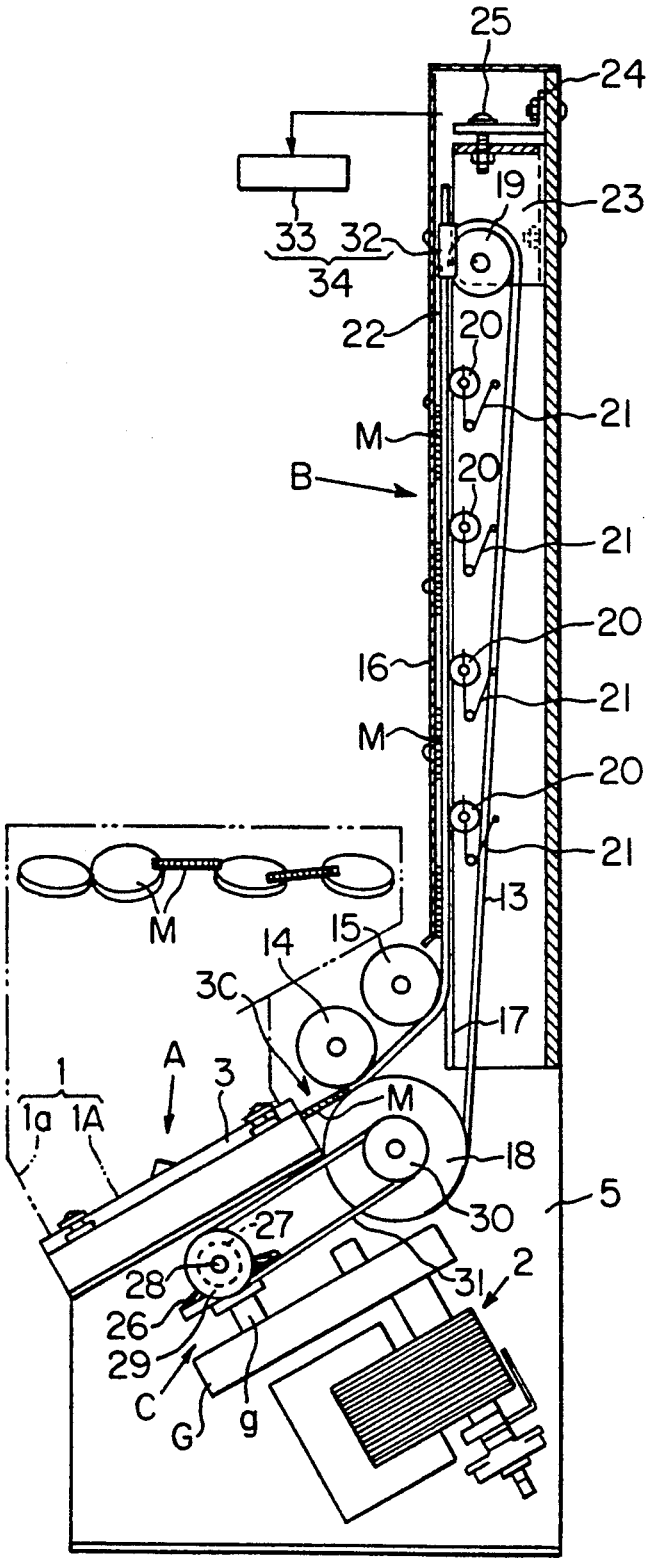
FIG. 1 is a side view in vertical section showing a disc conveyor relating to one embodiment.

FIG. 1 shows a disc conveyor of one embodiment. As shown, the conveyor includes a feeding device A for serially feeding a plurality of medals M, as an example of disc-like objects, and a forcible transporting device B for receiving the objects from the feeding device A and then transporting them to a predetermined position.

In the feeding device A, a bottom plate 1A of an upwardly opened hopper 1 is disposed with 30 degree inclination. On an upper face of this bottom plate 1A, there is mounted a rotary member 3 formed of resin material and rotatably driven by means of an electric motor 2 acting as a single drive source of the conveyor. The rotary member 3 defines a plurality of through holes 3A disposed with a predetermined peripheral distance therebetween. Each hole 3A has a diameter slightly greater than a diameter of the medal M.

The hopper 1 consists essentially of the above-described, resin bottom plate 1A bolted to a base plate 4 and a hopper case 1*a* fixedly mounted on the bottom plate 1A. A reference numeral 5 in FIG. 1 denotes a support mount for supporting the entire conveyor.

Figure 3:
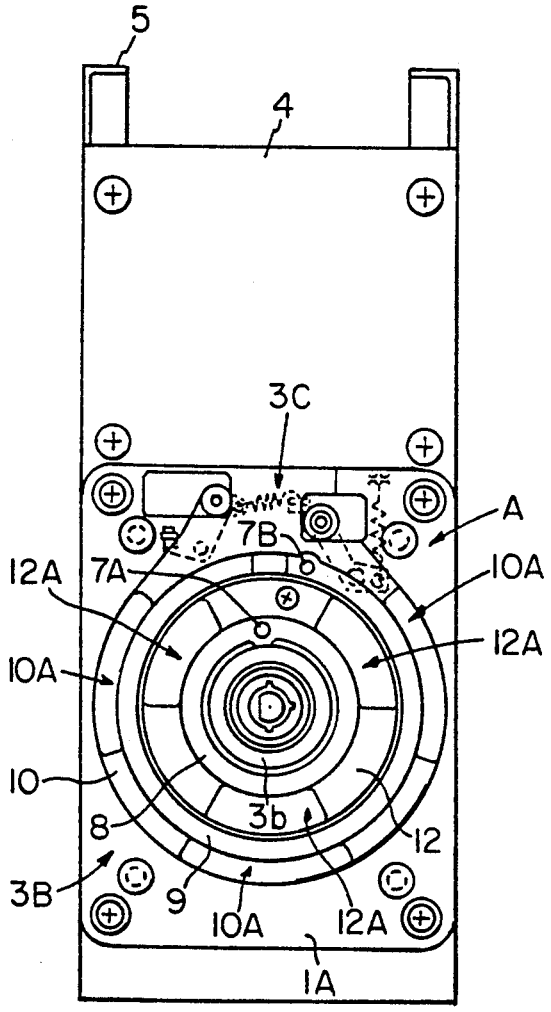
FIGS. 3 and 4 are front views showing a feeding device of the conveyor.

The bottom plate 1A, as shown in FIG. 3, defines a circular concave portion 3B for rotatably supporting the rotary member 3 and a medal feed opening 3C formed at an outer side of the concave portion 3B.

The rotary member 3, as shown in FIGS. 4 through 7, integrally mounts a receiver element 6 for holding a part of the medal M inserted through one through hole 3A positioned immediately above the element 6. Accordingly, the rotary member feeds the medal as mounted on the receiver element 6 through the through hole 3A.

Figure 4:
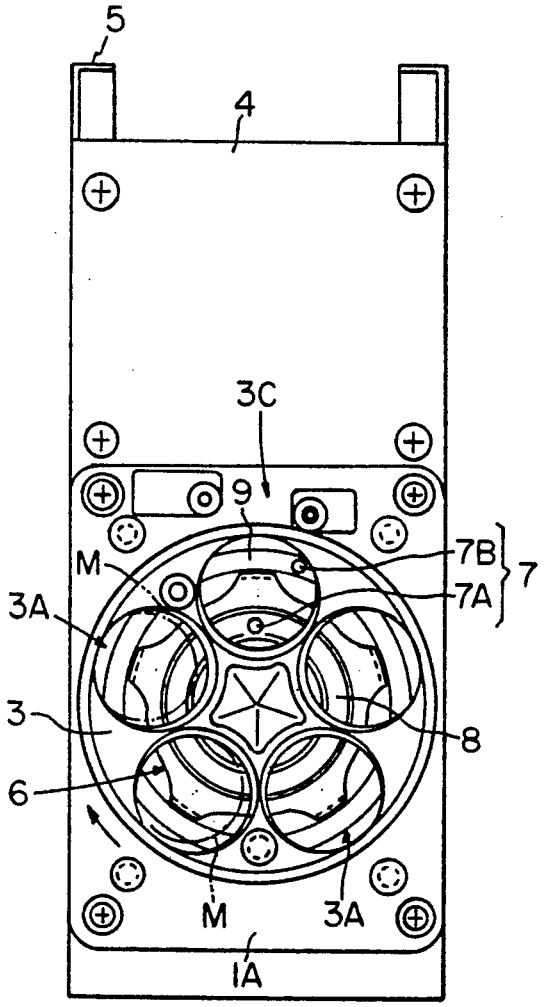
Figure 5:
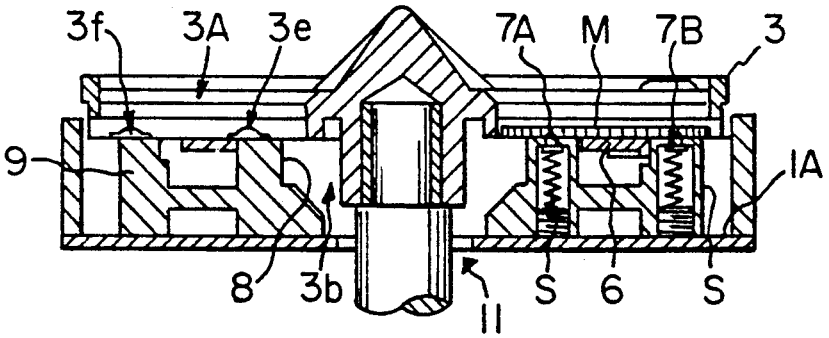
FIG. 5 is a vertical section showing a rotary member as attached to the conveyor.
Figure 6:
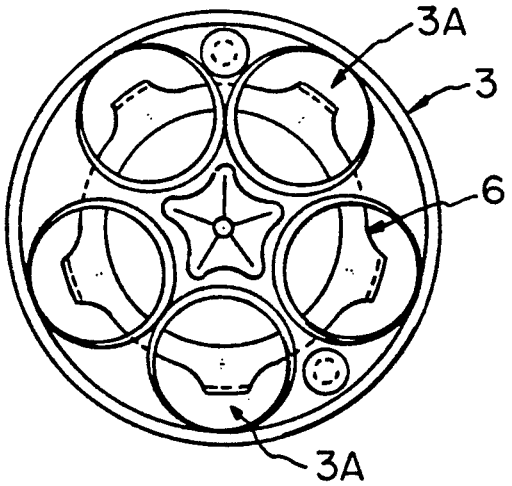
FIGS. 6 and 7 are a front view and a rear view of the rotary member.

Further, as shown in FIGS. 3 and 4, on the bottom plate 1A of the hopper 1, there is provided a guide portion 7 for guiding the medals M held inside the through holes 3A and pushed by rotation of the rotary member 3 to an outside of this rotary member 3. This guide portion 7 includes a pair of pin type guide elements 7A, 7B disposed at radially distant positions relative to a rotational direction of the rotary member 3. More particularly, in the circular concave portion 3B, there are projected a pair of annular slide guide portions 8 and 9 which come into sliding contact with a free face of the medal M carried on the receiver element 6 thus guiding this medal M. Then, the above-described guide elements 7A and 7B are attached respectively to the guide portions 8 and 9, with the one guide element 7B positioned radially outwards being displaced towards a downstream side of the rotational direction of the rotary member 3 relative to the other guide element 7A positioned radially inwards.

These guide elements 7A and 7B are movable between positions projecting upwards relative to the slide guide portions 8 and 9 and positions retracting into the guide portions 8, 9. And, springs S are provided for urging the guide elements 7A and 7B to the projecting positions. Accordingly, if the medal M carried by the rotary member 3 is entrapped between the rotary member 3 and the guide element 7A or 7B, with further rotation of the rotary member 3, the trapped medal M depresses the guide element 7A or 7B and rides over this element without being locked therein.

In the bottom plate 1A of the hopper 1, at a radially outward position relative to the through holes 3A, i.e. at a radially outermost position relative to the circular concave portion 3B, there is formed a peripheral groove 10 for receiving, by dropping, foreign substance such as dust and griding chips existing in the medals M from the rotary member 3. Further, the peripheral groove 10 has a plurality of outlet openings 10A for exhausting the foreign substance out of the system.

Similarly, at a small concave portion 3*b* formed at an innermost portion of the circular concave portion 3B, there is defined an outlet opening 11 for receiving dropping foreign substance and at a peripheral groove 12 formed between the two annular slide guide portions 8 and 9, there are formed a plurality of exhaust openings 12A for exhausting the dropped foreign substance therethrough.

Figure 7:
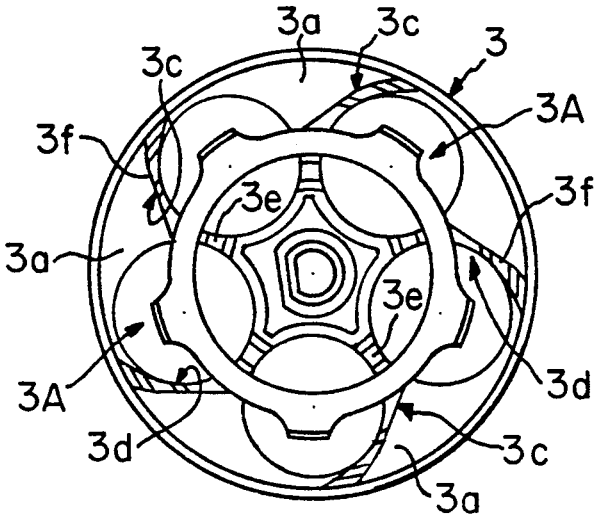

In the bottom face of the rotary member 3, as shown in FIG. 7, there are defined feeding grooves 3*a*, through which the medal M held into each through hole 3A is fed radially outwardly relative to the rotational direction towards the medal feed opening 3C.

Of wall faces forming the above feeding grooves 3*a*, one wall portion 3*c* positioned on the downstream side relative to the rotational direction is used for receiving the medal M held in the through hole 3A and for guiding this along a predetermined rotational path. Also, a further wall portion 3*d* positioned on the upstream side is used for pushing away the medal M in the radial outward direction relative to the rotational direction. Incidentally, reference marks 3*e* and 3*f* denote play grooves for allowing relative rotation between the rotary member 3 and the guide elements 7A, 7B.

Next, the forcible transporting device B will be described in particular.

This forcible transporting device B is so constructed as to receive the medals M serially fed from the feeding device A and then to serially transport these medals M to a predetermined upper position.

Figure 2:
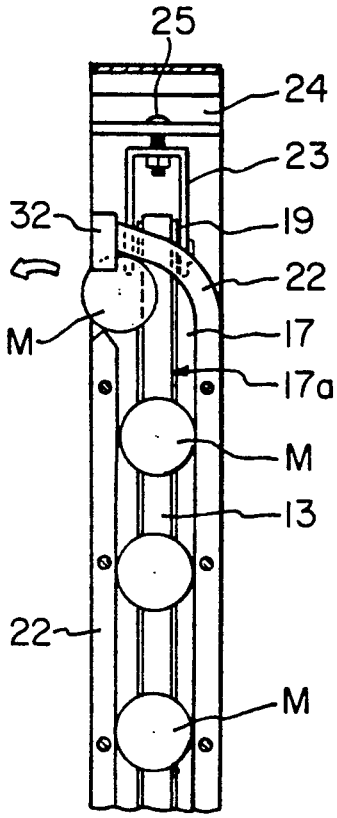
FIG. 2 is a partially cutaway front view of a forcible transporting device used in the conveyor.

More particularly, as shown in FIGS. 1 and 2, the transporting device B includes an endless belt 13 disposed along a medal transporting passage for applying frictional transporting force to the medals M. This endless belt 13, formed of rubber material, has a shorter width than the diameter of the medals M. Adjacent a transport start point of this endless belt 13, there are provided a pair of opposed driven rollers 14, 15 for transporting the medals M in cooperation with the belt 13. Further, at a position of the belt 13 extending immediately rearward from the driven roller 15 positioned more downstream relative to the transporting direction than the other roller 14 to a transport end position, there is provided a guide member 16 formed of transparent resin material, such that the guide member 16 guides by its friction the medals M being transported by the endless belt 13.

The endless belt 13 is reeved around a plurality of rollers 18, 19 disposed at appropriate upper and lower positions. And, this belt 13 is so disposed as to project towards the guide member 16 through a vertical hole 17A defined at a width-wise middle portion of a plate-like frame 17 fixedly mounted on the bottom plate 1A. Further, between the upper and lower rollers 18 and 19, there are provided a plurality of free rollers 20 so as to urge the endless belt 13 towards the guide member 16.

Each free roller 20 is movable in a direction of the thickness of the transported medal M and is urged by means of a spring 21 towards the guide member 16.

The frame 17 includes a pair of guide plates 22, 22 which come into abutment against peripheral edges of the transported medal M thus restricting movement of this medal M width-wise relative to the transporting direction. Further, as shown in FIG. 2, one guide plate 22 of these plates 22, 22 has its terminal end, relative to the guiding direction, bent so as to exhaust the medal transported upwards on the belt 13 to a direction (i.e. a direction denoted with an arrow in the drawing) normal to the medal transporting direction.

The upper rollers 19 of the roller pairs 18, 19 are rotatably attached to a movable bracket 23 attached to the frame 17 to be longitudinally movable relative thereto. This movable bracket 23 and an 'L'-shaped stationary bracket 24 attached to the frame 17 are operatively connected with each other through a bolt 25. Then, by rotating this bolt 25, the movable bracket 23 is moved to adust tension applied to the endless belt 13.

Further, the forcible transporting device B is driven by the electric motor 2 through a gear mechanism C as an example of a correlating mechanism of the invention for operatively correlating the feeding device A and the forcible transporting device B.

More particularly, this correlating mechanism C includes, as essential components thereof, a first bevel gear 26 fixedly mounted on an output shaft g of a reduction gear mechanism G operatively connected with an output shaft of the electric motor 2, a second bevel gear 27 meshing the first bevel gear 26 and a timing belt 31 for operatively associating an output gear 29 fixed on a free end of a rotary shaft 28 mouting the above-mentioned second bevel gear 27 with an input gear 30 fixed on a further rotary shaft of the lower roller 18.

Adjacent the transport finish end of the forcible transporting device B, there are disposed an electrooptical type or magnetic type sensor 32 for sensing the medals M transported by the forcible transporting device B and a counter 33 for counting the number of the medals M based on an output signal from the sensor 32.

These sensor 32 and counter 33 together constitute a counter means 34 of the invention for sensing and counting the number of the medals M transported by the forcible transporting device B.

Moreover, the lower drive roller 18 for driving the endless belt 13 has a greater diameter than the upper drive roller 19, such that the transporting speed of the medals M transported by the forcible transporting device B is rendered greater than a feeding speed of the medals M fed by the feeding device A.

Accordingly, the forcible transporting device serially transports these medals M with an increased distance therebetween than a feeding distance of the feeding device A. As a result, accurate detection and counting of the medals M are possible even if the counter means 34 has only a moderate precision.

Next, some other embodiments of the present invention will be specifically described.

In the foregoing embodiment, the feeding device A feeds the medals one by one through its rotary member 3. Whereas, the forcible transporting device B also transports these medals one by one in a serially aligned state. Instead, it is conceivable for the feeding device A to include a pushing member for slidably pushing the medals M while constructing the forcible transporting device B as a belt conveyor for receiving the medals from this feeding device A to a predetermined position. Also, the specific constructions of these devices A and B may vary depending on the convenience.

Figure 8:
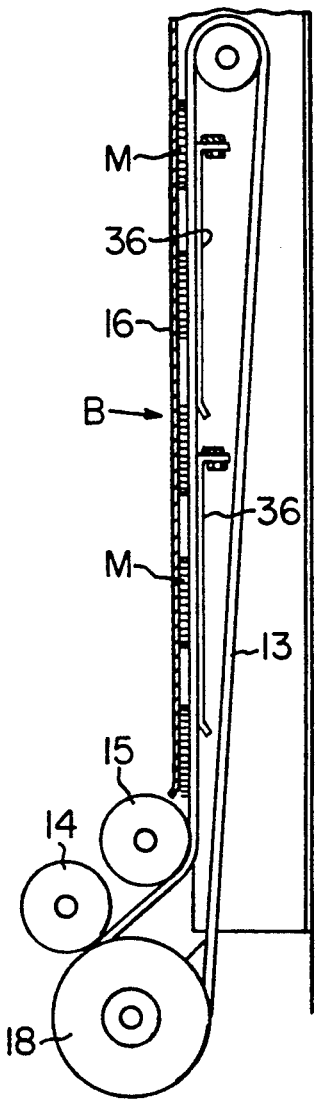

In the foregoing embodiment, the upper and lower intermediate portions of the endless belt 13 are urged towards the guide member 16 by means of a plurality of rollers 20 which in turn are urged by the springs 21. Instead, as illustrated in FIG. 8, it is also conceivable to urge, towards the guide member 16, these upper and lower intermediate portions of the endless belt 13 by means of a plurality of plate springs 36.

Further, in the foregoing embodiment, the foricible transporting device B is so constructed as to transport the medals to an upper position. Instead, it is conceivable for this device B to transport the medals M in a horizontal direction or in an obliquely downward direction. In these ways, the conveying direction of the medals M can be varied conveniently.

Figure 9:
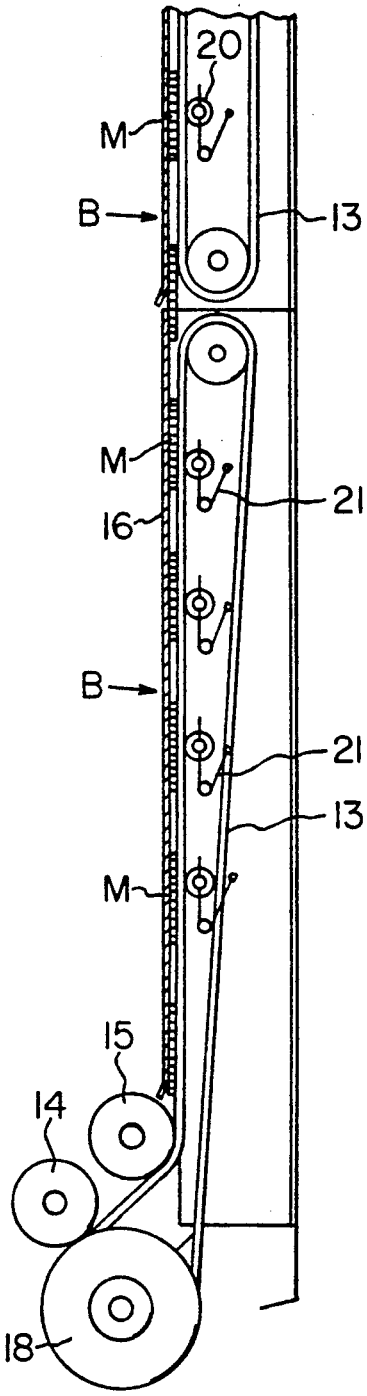

In the foregoing embodiment, the medals M are exhausted out of the conveyor at the transport end position of the forcible transporting device B. Instead, as illustrated in FIG. 9, it is conceivable to connect a further forcible transporting device B to the transport end of the former transporting device B so as to transport the medals to a farther upward position where the medals are finally exhausted.

Figure 10:
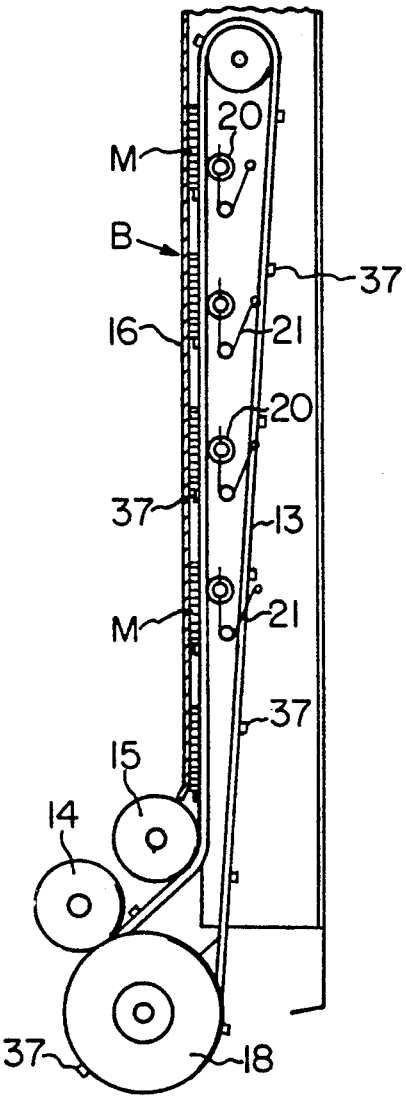
FIGS. 8 through 10 are side views in vertical section showing other embodiments of the disc conveyor, respectively.

The endless belt 13 can have any other cross section such as a circular section than the flat section disclosed in the foregoing embodiment. Moreover, as illustrated in FIG. 10, it is conceivable to form stopper projections 37 on the endless belt 13 so as to stop the medals M.

In the foregoing embodiment, the forcible transporting device B is driven by utilizing the electric motor adapted originally for driving the feeding device A. Instead, it is also conceivable to provide the electric motor to the forcible transporting device B and to drive the feeding device A by utilizing this motor attached to the forcible transporting device B.

In the foregoing embodiment, the electric motor 2 is used as the drive source for driving the feeding device A. Instead, a supersonic wave motor or a rotary solenoid or the like may be employed for this purpose.

Furthermore, in the foregoing embodiment, the transporting speed of the forcible transporting device B is set higher than the feeding speed of the feeding device A. Alternately, it is also possible to embody the present invention by setting these speeds same.

The invention is applicable also to any other disc-like object than the medals M employed in the disclosed embodiments.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A disc conveyor comprising:

a hopper including a bottom plate for holding disc-like objects;

a feeding device including a rotary member mounted on an upper face of said bottom plate of said hopper, said feeding device serially feeding the objects one by one;

said rotary member defining a plurality of through holes, a receiver element formed integrally with said rotary member on a reverse side of said rotary member, a first wall portion in said rotary member adapted to convey the object received by said through hole, and a second wall portion in said rotary member adapted to push the object outwardly in a radial direction;

said bottom plate including a circular concave portion rotatably supporting said rotary member, a disc-like object feed opening formed on an outer side of said concave portion;

first and second annular guide portions defined in said circular concave portion, wherein the objects are adapted to slidably contact said first and second guide portions, said first and second guide portions being arranged within an annular area through which said through hole is adapted to move, said first guide portion being positioned radially inwardly of said second guide portion;

a third guide portion for guiding the objects to an outside of said rotary member and a peripheral groove are provided in said bottom plate, said peripheral groove allows foreign substance chips existing in the objects to be dropped from said rotary member, said third guide portion including first and second pin-like guide elements disposed adjacent said disc-like object feed opening, said first guide element being mounted on said first guide portion, said second guide element being mounted on said second guide portion;

a forcible transporting device for forcibly receiving and holding the objects fed in a serially aligned state from said feeding device, said forcible transporting device transporting the objects at a higher speed than the feeding device;

counter means provided adjacent said forcible transporting device for detecting and counting the objects transported from said forcible transporting device;

a single drive source for driving said feeding device and said forcible transporting device; and a correlating mechanism for operatively correlating said feeding device and said forcible transporting device.

2. A disc conveyor as defined in claim 1, wherein said bottom plate of said hopper is disposed with approximately 30 degrees inclination relative to the horizon.

3. A disc conveyor as defined in claim 1, wherein said first and second guide elements are movable between positions projecting upwards relative to said first and second guide portions and further positions retracting into said first and second guide portions, spring means being provided for urging said first and second guide elements to said projecting positions.

4. A disc conveyor as defined in claim 1, wherein said peripheral groove has a plurality of outlet openings for exhausting the foreign substance.

5. A disc conveyor as defined in claim 1, wherein said forcible transporting device includes an endless belt disposed along an object transporting passage for applying frictional transporting force to the objects, said belt having a width shorter than the diameter of the objects; adjacent a transport start point of said endless belt, there being provided a pair of opposed driven rollers for transporting the objects in cooperation with said belt; a guide member for guiding the objects transported by said belt, said guide member positioned at a position of said belt extending immediately rearward from one of said driven rollers.

6. A disc conveyor as defined in claim 5, wherein said endless belt is reeved around a plurality of rollers disposed at appropriate upper and lower positions, said belt being so disposed as to project towards said guide member through a vertical hole defined at a width-wise middle portion of a plate-like frame fixedly mounted on said bottom plate; between said upper and lower rollers, there being provided a plurality of free rollers pressing said endless belt towards said guide member.

7. A disc conveyor as defined in claim 6, wherein each said free roller is movable in a direction towards said guide member and is urged by means of a spring towards said guide member.

8. A disc conveyor as defined in claim 7, wherein said frame includes a pair of guide plates which come into abutment against peripheral edges of the objects thus restricting movement of the objects width-wise relative to the transporting direction; one of said guide plates having a terminal end thereof, relative to the guiding direction, bent so as to exhaust the objects transported upwards on said belt to a direction normal to said transporting direction.

9. A disc conveyor as defined in claim 5, wherein said endless belt is urged towards said guide member by means of a plurality of plate springs.

10. A disc conveyor as defined in claim 5, wherein a further forcible transporting device is connected to a transport end of said forcible transporting device so as to transport the objects to a position where the objects are finally exhausted out of said further forcible transporting device.

11. A disc conveyor as defined in claim 6, wherein said endless belt forms, on a surface thereof, a stopper projection for stopping the objects.

12. A disc conveyor as defined in claim 1, wherein said correlating mechanism includes a first bevel gear fixedly mounted on an output shaft of a reduction gear mechanism operatively connected with an output shaft of said drive source, a second bevel gear meshing with said first bevel gear, an output gear fixed on a free end of a rotary shaft mounted on said second bevel gear, an input gear fixed on a rotary shaft of a lower roller and a timing belt connecting said output gear with said input gear.

* * * * *